United States Patent [19]

Minkin

[11] Patent Number: 4,741,351

[45] Date of Patent: May 3, 1988

[54] PARTS WASHER

[75] Inventor: Gary E. Minkin, Saint Louis, Mo.

[73] Assignee: The Modern Auto Recycling Techniques Corporation, St. Louis, Mo.

[21] Appl. No.: 709,079

[22] Filed: Mar. 7, 1985

[51] Int. Cl.[4] ..... B08B 3/02

[52] U.S. Cl. ..... 134/144; 134/172; 134/180; 134/199; 74/42; 239/245

[58] Field of Search ..... 134/129, 137, 139, 140, 134/144, 147, 148, 149, 172, 180, 181, 199; 74/42; 239/242, 227, 243, 245

[56] References Cited

U.S. PATENT DOCUMENTS

| | | | |
|---|---|---|---|
| 1,444,091 | 2/1923 | White | 74/42 |
| 1,621,665 | 3/1927 | Greve | 74/42 |
| 2,379,506 | 7/1945 | Yerrick et al. | 134/180 X |
| 2,696,823 | 12/1954 | Scott | 134/181 X |
| 3,139,761 | 7/1964 | Gindroz, Jr. | 74/42 |
| 3,419,429 | 12/1968 | Zadron et al. | 134/144 X |
| 3,459,891 | 8/1969 | Ladney, Jr. | 118/322 X |
| 3,504,683 | 4/1970 | Timmer et al. | 134/200 X |
| 3,734,591 | 5/1973 | Howe | 74/97 X |
| 4,143,669 | 3/1979 | Minkin | 134/200 X |
| 4,175,575 | 11/1979 | Cushing | 134/180 X |
| 4,213,475 | 7/1980 | Minkin | 134/111 |
| 4,451,716 | 5/1984 | Lorenz . | |

FOREIGN PATENT DOCUMENTS

| | | | |
|---|---|---|---|
| 1428359 | 11/1968 | Fed. Rep. of Germany | 134/181 |
| 93639 | 12/1938 | Sweden | 134/180 |
| 463720 | 11/1968 | Switzerland | 134/181 |

*Primary Examiner*—Harvey C. Hornsby
*Assistant Examiner*—Frankie L. Stinson
*Attorney, Agent, or Firm*—Wood, Dalton, Phillips, Mason & Rowe

[57] ABSTRACT

A parts washer and a method of washing parts. The parts washer has a cabinet having a rotatable turntable for carrying parts in a circular path and an oscillating spray manifold has spray nozzles directed toward the top, bottom and side of the parts and is caused to oscillate in an advancing movement counter to the direction of travel of the parts on the turntable and a return movement. The rate of travel of the spray nozzles varies in the two directions of movement with slower travel in the advancing movement and fast return movement to insure that successive sprays delivered by the spray nozzles in the advancing movement overlap on the parts to avoid any striping effect on the parts.

1 Claim, 3 Drawing Sheets

PARTS WASHER

BACKGROUND OF THE INVENTION

This invention pertains to a parts washer having structure providing for improved washing of parts, such as automotive parts and the like, and a method of washing parts.

Parts washers are well known in the art and have a cabinet in which a rotatable turntable is positioned and which supports parts for movement relative to liquid spray structure, such as spray nozzles which direct cleaning fluid against the parts. The parts washer has particular utility in the automotive field for cleaning various automotive components including engine parts during overhaul of a vehicle or for resale.

Examples of such parts washers are disclosed in my prior Pat. Nos. 4,143,669 and 4,213,475. A cabinet has a turntable movable between a position outside the cabinet and a position within the cabinet and with drive means therefor whereby parts mounted on the turntable may move in an arcuate path of travel relative to a plurality of spray nozzles positioned both above and below the turntable and to a side thereof which direct sprays of cleaning fluid against the parts. The spray nozzles and the supporting tubes which direct cleaning fluid thereto are referred to as a spray manifold.

It is also known in the prior art to have an oscillating spray manifold wherein the spray nozzles are caused to oscillate in advance and return movement. In the advancing movement, the spray nozzles move counter to the direction of movement of the parts on the turntable and, in the return movement, the spray nozzles move in the same direction as the parts. In the prior art device, the cleaning action of the parts is not completely satisfactory since, on the return movement of the spray manifold, the sprays delivered by the spray nozzles tend to cause a striping effect on the parts being washed, apparently due to the orientation of unwashed material on the parts and the fact that the speed of the turntable and the spray manifold appear to be synchronized.

The invention to be described hereinafter avoids the problems encountered with the prior art parts washer with an oscillating spray manifold by having an oscillating spray manifold which is not synchronized with the turntable and which has different speeds of operation in advance and return movement. There is also a short dwell at the end of each of the movements. Additionally, the spray pattern provided by the oscillating spray manifold of the invention avoids the formation of a vortex within the cabinet and resulting ineffective cleaning.

SUMMARY OF THE INVENTION

A primary feature of the invention is to provide a parts washer having a cabinet with a turntable rotatably mounted therein for supporting parts to be washed and for moving the parts in a circular path, spray means for directing cleaning fluid onto the moving parts including a plurality of spray nozzles directed toward the turntable, and means for oscillating said spray nozzles in advance and return directions in nonsynchronized relation with the turntable and with the speed of movement of the spray nozzles in the advancing direction counter to the direction of travel of the parts being slower than the return movement thereof.

Another feature of the invention is to provide a parts washer as defined in the preceding paragraph wherein a spray manifold has said plurality of spray nozzles mounted on a vertical tube and a pair of outwardly-extending arms and drive means for the oscillating spray manifold is operable independently of a drive means for the turntable and includes linkage structure connected to the vertical tube and to a rotatable crank arm, with the linkage and rotatable crank arm being constructed and arranged to provide the different speeds of advance and return movement of the oscillating spray manifold.

An object of the invention is to provide a new and improved parts washer for cleaning parts by means of an oscillating spray manifold and without any striping effect on the parts being washed.

Still another object of the invention is to provide a parts washer comprising, a cabinet, a turntable rotatably mounted in said cabinet for supporting parts to be washed and for moving said parts in a circular path within the cabinet, and spray means for directing cleaning fluid onto said moving parts, said spray means including a plurality of spray nozzles directed toward the turntable, and means for oscillating said spray nozzles in advance and return directions about an axis parallel to the axis of the turntable rotation and with the speed of movement being different in said two directions of movement.

An additional object of the invention is to provide a parts washer comprising, a cabinet, a turntable positionable in the cabinet for supporting parts to be washed and rotatable about an axis of rotation, drive means for rotating the turntable, a spray manifold having a vertical tube pivotally mounted for movement about an axis parallel to said axis of rotation, an upper arm extending from said vertical tube, a lower arm extending from said vertical tube, said lower arm and upper arm having spray nozzles to direct sprays of cleaning fluid toward the top and bottom of parts on the turntable, and means for oscillating said spray manifold about the pivot axis of the vertical tube in an advancing movement counter to the direction of turntable rotation and in an opposite return movement, said means for oscillating including a motor and drive connections between the motor and the vertical tube to cause the return movement to be faster than the advancing movement and at a cycle speed to assure that the spray from the spray nozzles in successive advances of the spray manifold has overlapping contact with a part on the turntable.

An added object of the invention is to provide a method of washing parts in a parts washer comprising, moving the parts in a circular path about a central axis, directing sprays of cleaning fluid toward the top, bottom and side of the moving parts, and moving said sprays of cleaning fluid back and forth in an arcuate path about an axis offset from and parallel to said central axis with the speed of movement of said sprays differing in the two directions of movement.

A further object of the invention is to provide a method as defined in the preceding paragraph wherein the sprays move in said arcuate path in a direction opposite to the travel direction of the parts at a first relatively slow speed and in the opposite direction at a second higher speed.

An additional object of the invention is to provide an arrangement of spray nozzles for a spray manifold which delivers spray blasts in mutually distinct non-intersecting planes to avoid formation of a vortex to assure that all of the spray blasts are directed against the parts being washed.

DESCRIPTION OF THE PREFERRED EMBODIMENT

Figure 1:
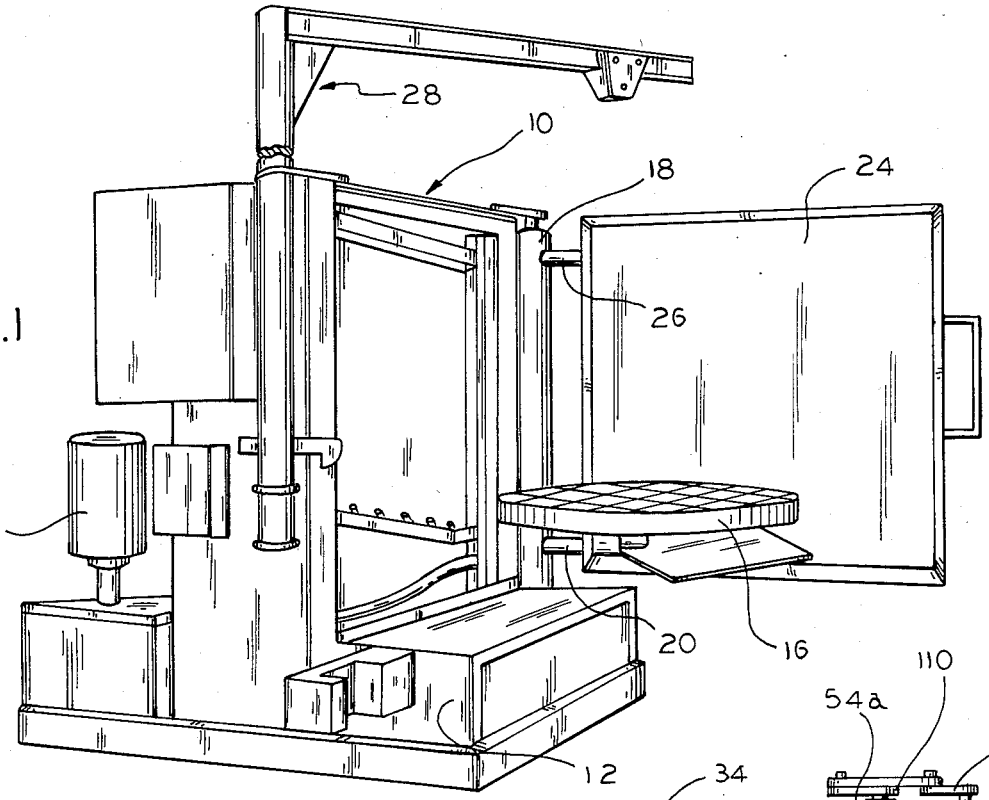
FIG. 1 is a perspective view of the parts washer, looking toward the front thereof, with a movable door of the cabinet shown in open position.

The parts washer is shown generally in FIG. 1 and has a cabinet, indicated generally at 10, with a front opening and which is disposed above a base 12 having a reservoir for receiving cleaning fluid sprayed within the cabinet and for providing a cleaning fluid supply to a pump driven by a motor 14 which supplies cleaning fluid under pressure to the oscillating spray manifold to be described.

A turntable 16 for supporting parts to be washed swings about a rotatably-mounted vertical column 18 and is carried by an arm 20 extending from the column and which mounts bearing means for rotatably supporting a turntable shaft 22. The turntable 16 can rotate within the cabinet and move the parts to be washed in a circular path.

A door 24 for closing a front opening of the cabinet is supported from the rotatable column 18 by the arm 20 and by an upper arm 26 whereby opening and closing movement of the door 24 will result in positioning of the turntable 16, either within the cabinet for parts washing, or outside of the cabinet for loading and unloading of parts. As an assist to loading and unloading of parts, a crane unit, indicated generally at 28, is rotatably mounted on and extends upwardly from the cabinet 10.

Figure 2:
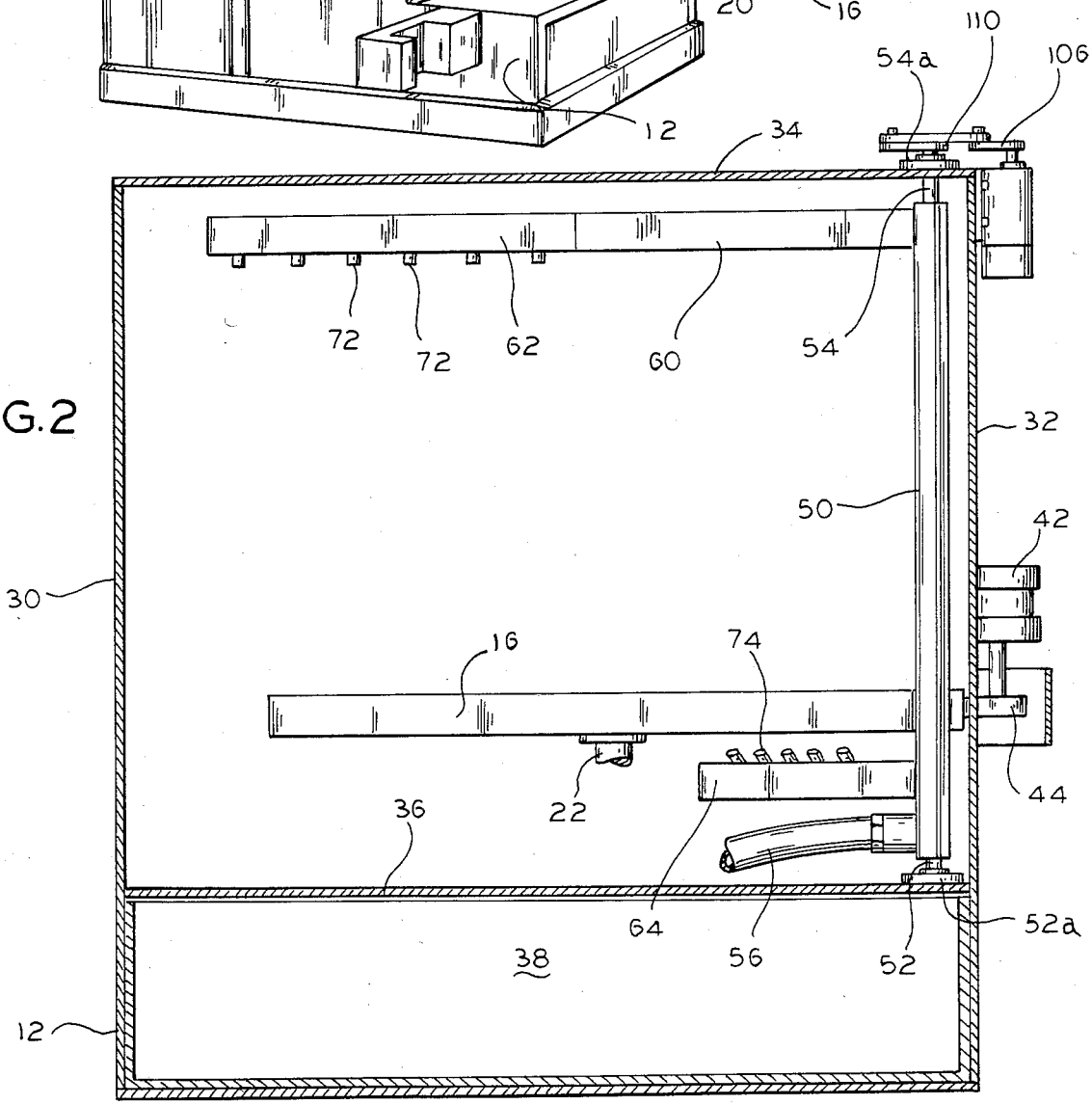
FIG. 2 is a transverse section, taken generally along a line extending immediately behind the front wall of the cabinet.

As seen particularly in FIG. 2, the cabinet 10 has side walls 30 and 32, a top wall 34, and a perforate bottom wall 36, which communicates with a reservoir 38 in the base 12.

The turntable 16 is rotatably driven by a motor 42 yieldably mounted outside the cabinet side wall 32 and having a drive wheel 44 which extends through an opening in the cabinet side wall and engages the periphery of the turntable.

The foregoing structure is generally as shown in my previous U.S. Pat. Nos. 4,143,669 and 4,213,475 and the general structure of the parts washer as shown therein is incorporated herein by reference.

The oscillating spray manifold comprises a vertical tube 50 extending upwardly along a front corner of the cabinet and pivotally mounted at its ends by a pivot pin 52 at its lower end and a pivot pin 54 at its upper end. The pins are fixed to closed ends of the tube whereby cleaning fluid can be directed to the vertical tube by the pump through a flexible hose 56. The pins 52 and 54 are rotatably mounted in bearings 52*a* and 54*a* secured to the cabinet.

Figure 3:
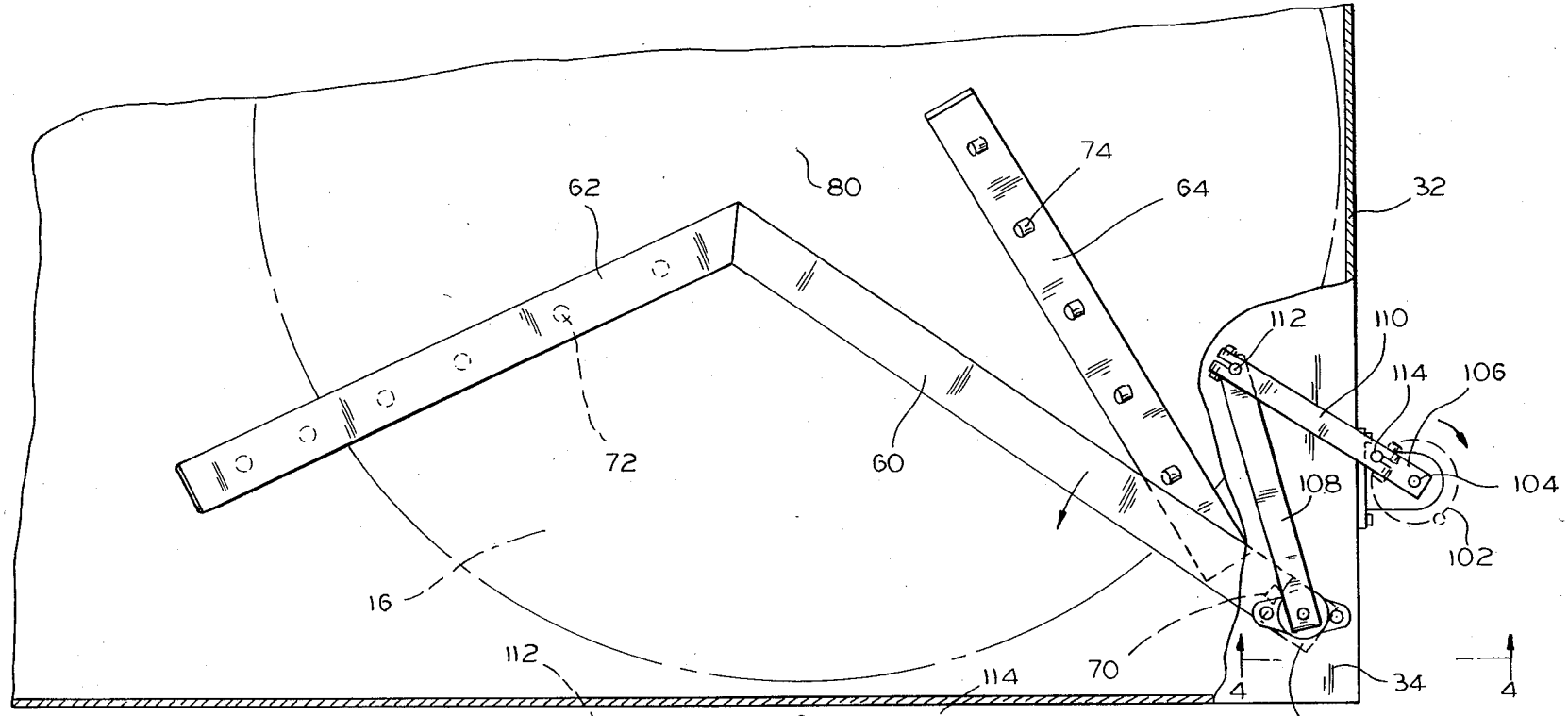
FIG. 3 is a fragmentary plan view of the parts washer, with part of the cabinet broken away and with the turntable shown only in broken line for clarity.
Figure 5:
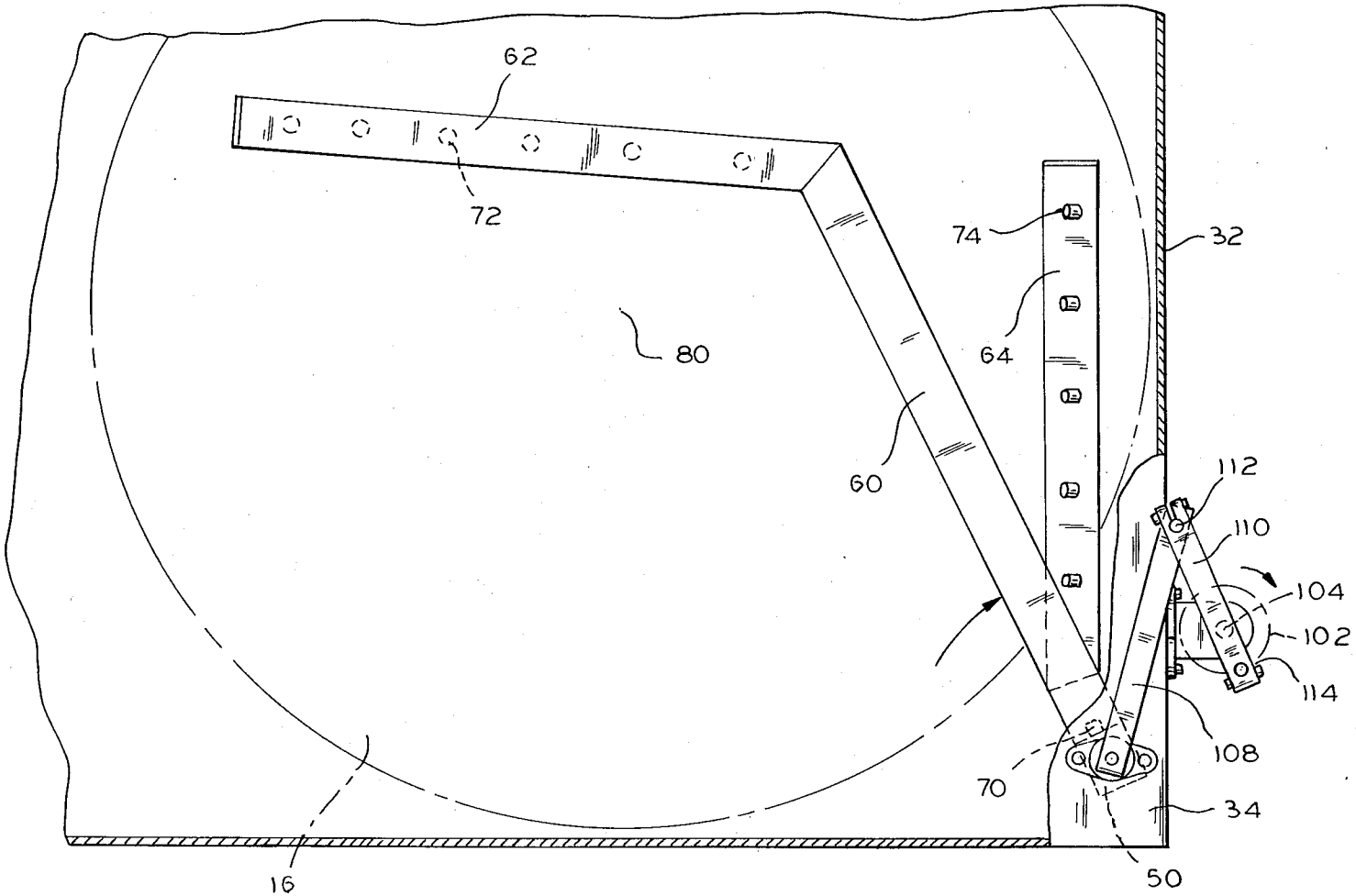
FIG. 5 is a view, similar to FIG. 3, showing the oscillating spray manifold at a limit of movement opposite from that shown in FIG. 3.

The oscillating spray manifold also includes a V-shaped upper arm having a first section 60 and a distal section 62 which are angularly related and with the section 60 being fixed at one end to the upper end of the vertical tube 50 and having an interior in fluid communication with the interior of the vertical tube. A lower arm 64 extends from the lower end of the vertical tube and has an open interior in communication with the open interior of the vertical tube 50. The vertical tube 50, distal section 62 and lower arm 64 each mount a series of spray nozzles along the length thereof for directing cleaning fluid toward the top, bottom and sides of the parts carried by the turntable 16. One of the spray nozzles 70 carried by the vertical tube 50 is seen in FIGS. 3 and 5. A series of spray nozzles 72 depend from the distal section 62 of the upper V-shaped arm and a series of spray nozzles 74 extend upwardly from the lower arm 64. With pivotal mounting of the vertical tube 50, the oscillating spray manifold can oscillate about an axis defined by the pivot pins 52 and 54 and which is parallel to and offset from an axis of rotation identified at point 80 for the turntable 16. The oscillating spray manifold has a fully advanced position shown in FIG. 3 and a return position shown in FIG. 5, with there being oscillating movement of the spray manifold between these two positions.

The turntable 16 is caused to rotate in a clockwise direction, as viewed in FIGS. 3 and 5, by operation of the motor 42. The advancing movement of the oscillating spray manifold is in a counterclockwise direction wherein the spray nozzles 72 are caused to move counter to the path of travel of the parts on the turntable. The return movement of the oscillating spray manifold causes the spray nozzles 72 to move with the travelling parts.

Figure 4:
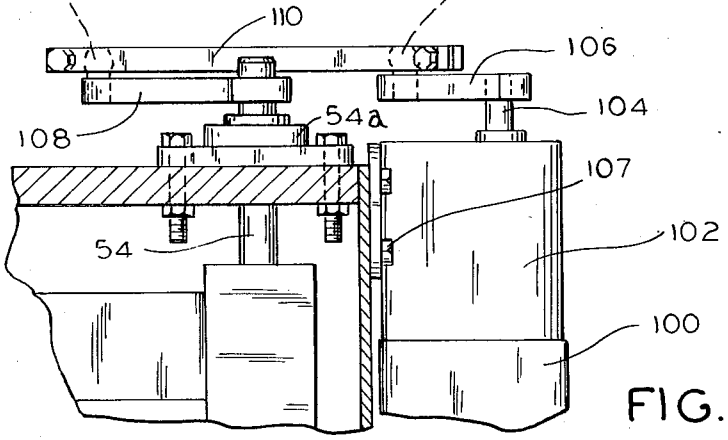
FIG. 4 is a vertical section, taken generally along the line 4—4 in FIG. 3 and on an enlarged scale.

The oscillating spray manifold operates at different travel speeds in the advancing and return movements, with a relatively slow advancing movement and a faster return movement, and with a slight dwell at the end of each of the movements. The drive means for accomplishing this includes a motor 100 with a gear reduction unit 102 having an output shaft 104 mounting a crank arm 106. The motor and gear reduction unit are mounted to the side wall 32 of the cabinet by attaching means, as indicated at 107. The crank arm 106 is operatively connected to a link 108 fixed to an upper end of the pivot pin 54 by an interconnecting link 110. The interconnecting link 110 has a pair of shaped recesses to receive pins with spherical heads to permit pivoting movement of the interconnecting link 110 relative to the links 106 and 108. The spherical headed pins are shown in broken line at 112 and 114 in FIG. 4 and are also seen in FIG. 3. The pins 112 and 114 are carried by the link 108 and the crank arm 106, respectively. The ends of the interconnecting link 110 are bifurcated to enable flexing thereof to receive the spherical heads of the pins and with tightening bolts associated therewith to bring the ends of the interconnecting link in relatively close, but slidable connection with the spherical heads of the pins 112 and 114.

The drive means including the crank arm and the links associated therewith are constructed and arranged to provide the different rates of movement in advance and return of the oscillating spray manifold, as previously described. This is accomplished by having the crank arm 106 rotate in a clockwise direction whereby, as seen in FIG. 3, the spherical-headed pin 114 is caused to move in a clockwise arc which results in a substantially direct clockwise pivoting of the link 108 and resulting movement of the oscillating spray manifold. This movement continues until the crank arm reaches the position shown in FIG. 5 at the end of the return movement. There is a relatively slow advancing movement of the oscillating spray manifold as the crank arm 106 moves from the position seen in FIG. 5 back to the position seen in FIG. 3. There is a slight dwell as the crank arm moves in an arc adjacent the positions shown in FIGS. 3 and 5.

It has been found that the best washing action is obtained when the turntable is caused to rotate at a speed which results in the periphery thereof travelling at 36 feet per minute, approximately, and with the oscillating spray manifold being caused to sweep through an angle of 30° in the advancing movement counter to the travel of the parts on the turntable every five seconds, approximately. More of the cycle time is taken up in the slow advancing movement as compared to the fast return movement of the oscillating spray manifold. This assures overlapping the spray passes on the parts carried on the turntable which avoids any striping of the parts load.

With the previous description, it will be evident that a method of washing parts has been disclosed which comprises the steps of moving the parts in a circular path about a central axis and directing sprays of cleaning fluid toward the top, bottom and side of the moving parts, moving the sprays of cleaning fluid back and forth in an arcuate path about an axis offset from and parallel to the axis of rotation of the turntable and with the speed of movement of the sprays differing in the two directions of movement. Additionally, the method embodies moving the sprays in an arcuate path in a direction opposite to the travel direction of the parts at a first relatively slow speed and, in the opposite direction, at a second higher speed and, more particularly, wherein the parts travel about a central axis at an approximate rate of 36 feet per minute, with the sprays making a back and forth cycle of movement of approximately a 30° arc at a cycle speed of five seconds to cause successive spray passes to overlap on the parts. The vertical tube 50, upper arm sections 60 and 62, and lower arm 64 of the oscillating spray manifold are constructed and arranged to have their respective spray nozzles 70, 72 and 74 direct the spray blasts of cleaning fluid in three mutually distinct nonintersecting planes. This is achieved by the angular relation of the lower arm 64 to the upper arm sections 60 and 62 and by the spray nozzles 70 on the vertical tube 50 being directed in a plane generally bisecting the angle between the arms. As a result, the full force of each spray blast can reach the parts carried on the turntable 16. This delivery of the spray blasts in mutually distinct nonintersecting planes provides improved results over prior art washers wherein the spray patterns intersected by having the sprays from the top and bottom as well as across the turntable all being directed in the same common plane and directed at the center of the wash load. With the single plane configuration, the horizontal spray pattern delivered across the turntable delivered sufficient force to create a vortex within the cabinet deflecting the spray from the upper arm of the spray manifold which thus became buried along the side of the cabinet. As a result, the downwardly-directed sprays from the upper arm almost completely missed the parts on the turntable.

The extension of the lower arm 64 at an angle from the vertical tube 50 and away from the turntable axis permits oscillation of the spray manifold without the lower arm interfering with the support structure for the turntable.

I claim:

1. A parts washer comprising, a cabinet, a turntable positionable in the cabinet for supporting parts to be washed and rotatable about an axis of rotation, drive means for rotating the turntable, a spray manifold having a vertical tube at one side of the turntable pivotally mounted for movement about an axis parallel to said axis of rotation, an upper arm extending from said vertical tube at a level above and spanning said turntable, a lower arm extending from said vertical tube at a level below said turntable, said lower arm and upper arm having spray nozzles directed toward said turntable at opposte sides of said axis of rotation thereof to direct sprays of cleaning fluid toward the top and bottom of parts on the turntable, said vertical tube also having spray nozzles, the upper and lower arms extending from the vertical tube at different angles and out of the plane of the spray nozzles on the vertical tube whereby the spray nozzles direct cleaning fluid toward the top, bottom and sides of parts on the turntable in three different nonintersecting planes, and means for oscillating said spray manifold about the pivot axis of the vertical tube in an advancing movement counter to the direction of turntable rotation and in an opposite return movement, said means for oscillating including a motor and drive connections between the motor and the vertical tube to cause the return movement to be faster than the advancing movement and at a cycle speed to assure that the spray from the spray nozzles in successive advances of the spray manifold has overlapping contact with a part on the turntable.

* * * * *